US008344642B2

(12) United States Patent
Noll

(10) Patent No.: US 8,344,642 B2
(45) Date of Patent: Jan. 1, 2013

(54) LIGHTING DEVICE HAVING A RAIL DEVICE THAT CAN BE FIXED TO A SURFACE OF AN OBJECT

(75) Inventor: Thomas Noll, Kipfenberg (DE)

(73) Assignee: OSRAM GmbH, Munich (DE)

( * ) Notice: Subject to any disclaimer, the term of this patent is extended or adjusted under 35 U.S.C. 154(b) by 323 days.

(21) Appl. No.: 12/601,851

(22) PCT Filed: May 21, 2008

(86) PCT No.: PCT/EP2008/056232

§ 371 (c)(1),
(2), (4) Date: Nov. 25, 2009

(87) PCT Pub. No.: WO2008/145576

PCT Pub. Date: Dec. 4, 2008

(65) Prior Publication Data

US 2010/0181922 A1 Jul. 22, 2010

(30) Foreign Application Priority Data

May 25, 2007 (DE) ..... 10 2007 024 419

(51) Int. Cl.
*H05B 41/24* (2006.01)
*H01R 33/00* (2006.01)

(52) U.S. Cl. ..... 315/276; 315/178; 362/648

(58) Field of Classification Search ..... 315/177, 315/178, 276, 281, 282, 291; 362/226, 228, 362/382, 648

See application file for complete search history.

(56) References Cited

U.S. PATENT DOCUMENTS

| | | | | |
|---|---|---|---|---|
| 6,107,756 | A * | 8/2000 | Parra | 315/324 |
| 6,152,583 | A | 11/2000 | Langner | |
| 6,597,129 | B2 * | 7/2003 | Newman | 315/291 |
| 7,132,802 | B2 * | 11/2006 | Fischer et al. | 315/224 |
| 7,139,680 | B2 * | 11/2006 | Orozco | 702/188 |
| 2004/0100207 | A1 * | 5/2004 | DeSisti et al. | 315/276 |

FOREIGN PATENT DOCUMENTS

| | | | |
|---|---|---|---|
| DE | 20009450 | U1 * | 8/2000 |
| DE | 20009450 | U1 | 9/2000 |
| EP | 340532 | A2 * | 11/1989 |
| JP | 225118 | U | 2/1990 |
| JP | 4351802 | A | 12/1992 |

OTHER PUBLICATIONS

International Search Report of PCT/EP2008/056232 mailed on Aug. 20, 2008.
English-language abstract for DE 200 09 450 U1, date: Jan. 4, 2010.
English abstract for JP 4351802A, Feb. 28, 2012.

* cited by examiner

*Primary Examiner* — Jimmy Vu

(57) ABSTRACT

A lighting device may include a transformer; a rail device, configured to be attached to a surface of an object, wherein the rail device has two rails, which are arranged so as to be spaced apart from one another, to which rail device a lamp can be attached and on which the lamp can be supplied with power, the rails being electrically connected to the transformer, at least one first lamp being arranged on the rails and being configured to be supplied with power in the low-voltage range via the transformer and the rails; and at least one second lamp being arranged on a housing of the transformer and being connected to the system voltage.

12 Claims, 2 Drawing Sheets

LIGHTING DEVICE HAVING A RAIL DEVICE THAT CAN BE FIXED TO A SURFACE OF AN OBJECT

Related Applications

The present application is a national stage entry according to 35 U.S.C. §371 of PCT application No.: PCT/EP2008/056232 filed on May 21, 2008, which claims priority from German application No.: 10 2007 024 419.5 filed on May 25, 2007.

BACKGROUND

The invention relates to a lighting device having a rail device that can be fixed to a surface of an object and has two rails, which are arranged so as to be spaced apart from one another, to which a lamp can be attached and on which said lamp can be supplied with power, the rails being electrically connected to a transformer.

Such lighting devices are known. These lighting devices include a plurality of halogen incandescent lamps, which are fastened on the rails and are designed for operation in the low-voltage range. Furthermore, such lighting devices are also known which are designed for operation in the high-voltage range.

SUMMARY

Various embodiments provide a lighting device having a rail device for attaching and for supplying power to lamps, in which the use can be designed to be more flexible.

A lighting device according to the invention includes a rail device, which can be attached to a surface of an object. The object may be, for example, a ceiling of a room or else a side wall of a room or of a building. These examples of objects should not be considered to be exhaustive. In principle, the rail device can be attached to any desired objects.

The rail device includes two rails which are arranged so as to be spaced apart from one another, to which a lamp can be attached and on which said lamp can be supplied with power. The power supply takes place via the rails, which are electrically conductive. The rails are electrically connected to a transformer. At least one first lamp is arranged on the rails and can be supplied with power in the low-voltage range via the transformer and the rails, and at least one second lamp is arranged on a housing of the transformer and is connected to the system voltage.

The low-voltage range is understood to mean in particular a voltage range of electrical voltages of less than 60V, in particular approximately 12V.

By virtue of the lighting device according to the invention, firstly a plurality of first lamps can be attached to the rails and said lamps can be supplied with voltage produced by the transformer and operated via said rails. Secondly, in addition at least one further lamp can be arranged on the housing of the transformer and can be supplied with power not using the voltage produced by the transformer, but be connected to the system voltage. By virtue of this concept, the usability of the lighting device can be designed to be substantially more flexible. Preferably, the first lamp is associated with a first lamp type and the second lamp is associated with a second lamp type which is different than the first lamp type. The lighting device therefore permits operation, in particular simultaneous operation, of different lamp types. Preferably, a first lamp type is a halogen incandescent lamp, a second lamp type is a discharge lamp, in particular a compact fluorescent lamp, referred to as an energy saving lamp, and a third lamp type is a light-emitting diode. By virtue of this design and the use of discharge lamps and/or light-emitting diodes, the lighting device also makes it possible to increase the luminous efficiency whilst at the same time saving energy.

It has proven to be particularly preferred if the second lamp, which is arranged on the housing of the transformer and is connected to the system voltage, is a discharge lamp, in particular a compact fluorescent lamp. Thus, a lighting system can be produced in a space-saving manner with little complexity which is in the form of a hybrid system and also includes at least one discharge lamp, in addition to the incandescent lamps which are arranged on the rails, for example. Preferably, the discharge lamp is in the form of a dimmable compact fluorescent lamp.

By slightly changing the housing of the transformer it is thus also possible for the integration of such a discharge lamp into the lighting device to be permitted. By virtue of at least one lampholder being attached to the transformer housing and this second lamp being connected to the mains terminal, a compact fluorescent lamp with an integrated electronic ballast can also be integrated into an existing halogen system with incandescent lamps without any substantial change to the lighting device.

The lampholder integrated in the housing of the transformer can be designed in such a way that it is provided for receiving a screw-type base of the second lamp. However, provision may also be made for the base of the second lamp to have a different design than a screw-type base. For example, a bayonet-type base or a pin base or the like can also be provided.

The transformer is in particular a toroidal-core transformer. The lighting device preferably includes a dimmer unit, in particular a phase-gating dimmer. As a result, a lighting device which is also intended for dimmable operation of the lamps arranged thereon can be produced.

Preferably, the second lamp, which is arranged on the housing of the transformer, is positioned between the two rails of the rail device. This makes a configuration possible which has a minimum installation space.

Preferably, the rail device includes two rails, which extend substantially parallel to one another and are arranged so as to be spaced apart from one another.

The lighting device preferably has a transparent cover, which covers the second lamp on the visible side and can be attached in particular to the housing of the transformer. In particular, a cover is provided which can be detached in a destruction-free manner and can therefore also be attached reversibly.

Provision can likewise be made for a reflector to be capable of being attached to the housing of the transformer instead of or in addition to the cover.

The lighting device can furthermore be designed in such a way that lamps of different lamp types can also be attached to the rails of the rail device. In particular, provision can be made for at least one lamp of a first lamp type and at least one lamp of a second lamp type to be capable of being attached to the rails and operated simultaneously. Thus, for example, provision can be made for at least one incandescent lamp and/or at least one discharge lamp and/or at least one light-emitting diode to be arranged on the rails and to be capable of being operated simultaneously.

BRIEF DESCRIPTION OF THE DRAWINGS

The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Identical or functionally identical elements have been provided with the same reference symbols in the figures.

Figure 1:
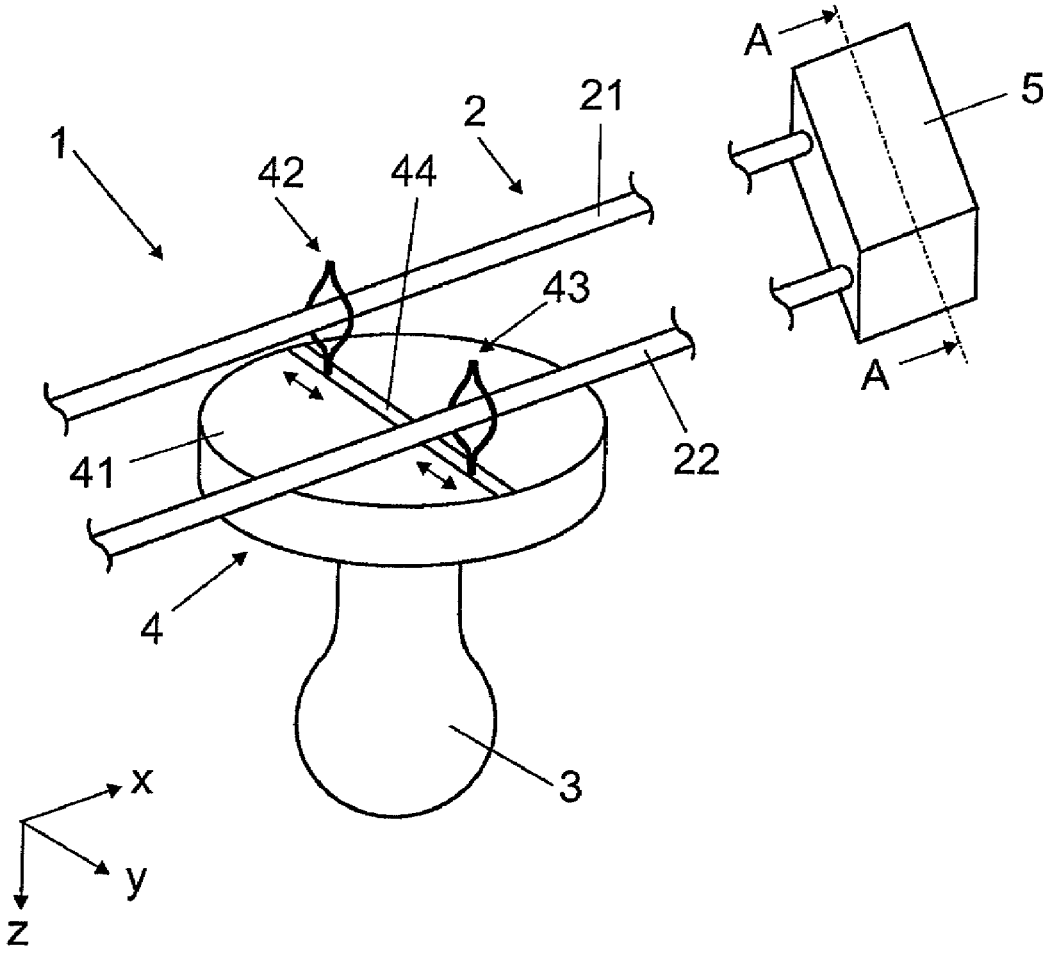
FIG. 1 shows a perspective illustration of a partial section of an exemplary embodiment of a lighting device according to the invention.

FIG. 1 shows a schematic illustration of a partial section of a lighting device 1, which includes a rail device 2 with a first rail 21 and a second rail 22. The two rails 21 and 22 are designed so as to be electrically conductive and run substantially parallel to one another and are arranged so as to be spaced apart from one another. The lighting device 1, in particular the rail device 2, can be fixed to a ceiling of a room.

The lighting device 1 includes a plurality of lamps, only one lamp 3 being shown by way of example in FIG. 1. The lamp 3 is in the form of an incandescent lamp and is fixed in such a way that it can be detached without being destroyed via an adapter 4 to the rails 21 and 22 with the fixing elements 42 and 43. The fixing elements 42 and 43 are arranged in a guide 44 of a basic body 41 of the adapter 4 and can be offset in the y direction relative to one another and relative to the basic body 41. As a result, the adapter 4 can be attached to rail devices 2 of different designs. In particular when rails 21 and 22 have different distances from one another in a device-specific manner, the adapter 4 can also then be matched in a compatible manner and fixed thereto.

Furthermore, the adapter 4 is also designed to receive other lamp types. Not only can a lamp 3 in the form of an incandescent lamp be attached, for example screwed or plugged onto the adapter 4, but also, for example, a compact fluorescent lamp or a light-emitting diode can be connected to the adapter 4.

The lighting device 1 is designed for the attachment and operation of lamps of different lamp types.

Provision can thus be made for one or more lamps 3 of a first lamp type to be arranged on the rails 21 and 22 and at least one second lamp to be attached to a transformer 5, which is in the form of a toroidal-core transformer, which second lamp represents a lamp type which is different from the lamps 3 which are arranged on the rails 21 and 22. If exclusively incandescent lamps are arranged on the rails 21 and 22, provision can thus be made for a second lamp 6 in the form of a compact fluorescent lamp (FIG. 2) to be arranged on a housing 51 of the transformer 5.

However, provision can likewise also be made for the lighting device 1 to be designed in such a way that incandescent lamps and/or discharge lamps and/or light-emitting diodes can also be attached to the rails 21 and 22 and operated simultaneously thereon.

In addition to the illustration shown in FIG. 1 with an adapter 4, provision can also be made for a lamp 3 to be attached using a customary conventional fixing method with such rail systems. A configuration which is compatible in use with an adapter 4 which can be adjusted variably for attaching different lamps and/or for attachment to different rail devices 2 is in this case not provided.

The lamps 3 arranged on the rails 21 and 22 are supplied with power in the low-voltage range via the transformer 5 and the rails 21 and 22. The second lamp 6 arranged on the housing 51 of the transformer 5 is not supplied with power via the transformer, but is connected to the system voltage.

Figure 2:
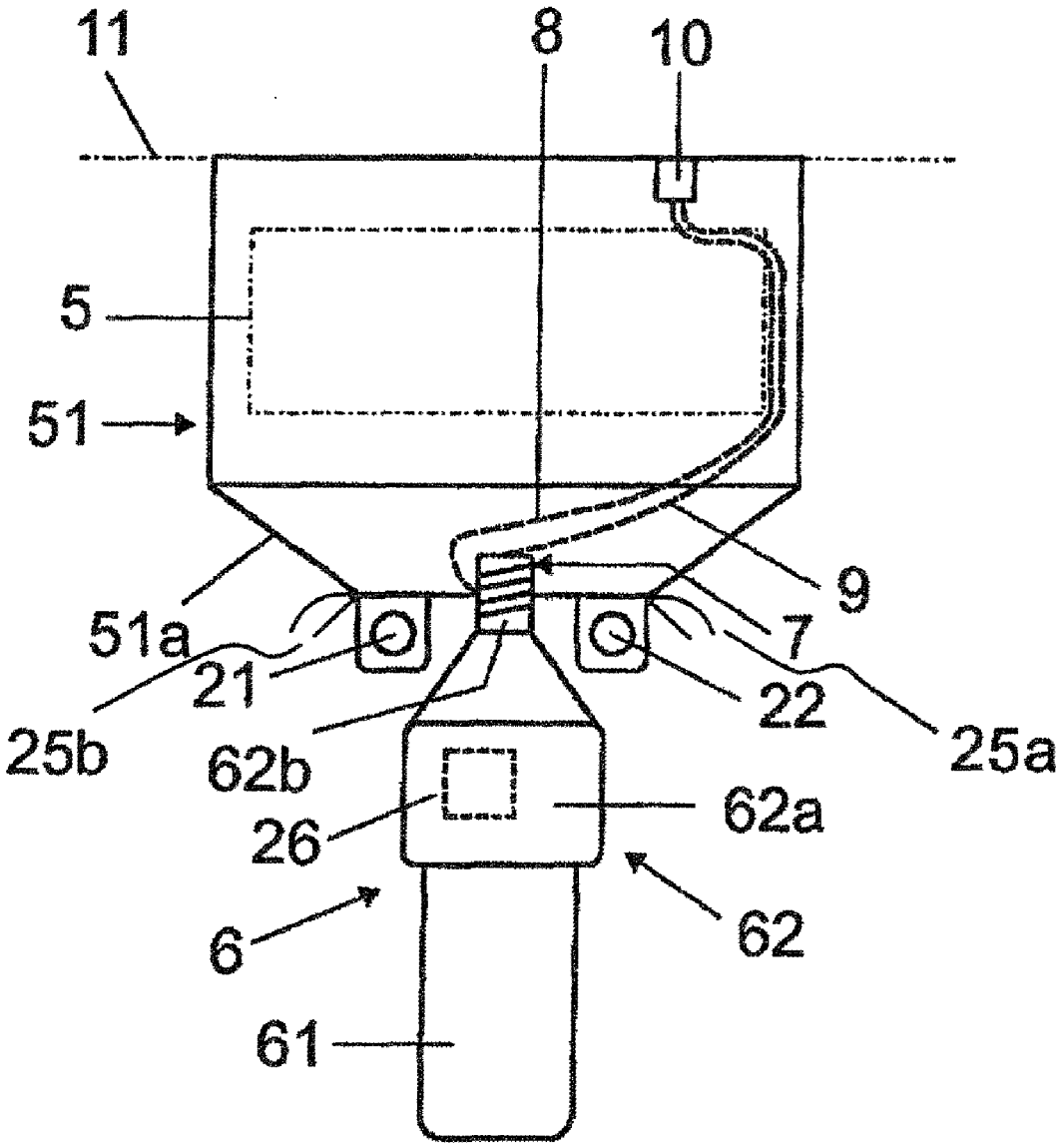
FIG. 2 shows a sectional illustration of the lighting device shown in FIG. 1.

FIG. 2 shows a schematic sectional illustration along the section line AA shown in FIG. 1. It can be seen here that the transformer 5, in particular the housing 51, is fixed on a ceiling 11 of a room.

The housing 51 of the transformer 5 has a lower, tapered subregion 51*a*. The rails 21 and 22, which extend perpendicular to the plane of the figure, are fixed on that side of this subregion 51*a* which is remote from the ceiling 11. In this conical subregion 51*a* of the housing 51, a lampholder 7 is formed between the rails 21 and 22, it being possible for a base 62*b* of the second lamp 6 to be introduced into said lampholder. The base 62*b* is associated with a lower part 62 of the second lamp 6, which lower part includes a housing 62*a*, in addition to the base 62*b*. An electronic ballast (not illustrated), which is provided for operation of the lamp 6, can be arranged in the housing 62*a*. The electronic ballast is preferably in the form of a fully dimmable device and is provided for operation using phase dimmers. A region of a discharge vessel 61 extends into this housing 62*a*.

The base 62*b* can be in the form of a screw-type base. However, a bayonet-type connection between the base 62*b* and the lampholder 7 can likewise be provided and thus a configuration which is different than a screw-type base can be introduced. The base 62*b* is connected to a luster terminal 10 via lines or signal links 8 and 9.

The second lamp 6 is therefore supplied with power via the system voltage and is furthermore also electrically connected to a dimmer unit 26, in particular a phase-gating dimmer 26.

All of the lamps 3 and 6 associated with the lighting device 1 are therefore also dimmable.

Furthermore, provision can be made for a transparent cover 25*b*, which covers the second lamp 6 on the visible side, to be arranged on the housing 51. Provision can likewise be made for a reflector 25*a* to be capable of being attached to the housing of the transformer instead of or in addition to the cover.

Provision can also be made for a plurality of second lamps 6 to be arranged on the housing 51 and to be connected to the system voltage. Provision can also be made for a second lamp 6 to be arranged not between the rails 21 and 22, but to be arranged, for example, on the sloping side wall of the conical subregion 51*a*.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A lighting device, comprising:

a transformer;

a rail device, configured to be attached to a surface of an object, wherein the rail device comprises two rails, which are arranged so as to be spaced apart from one another, to which rail device at least one first lamp is configured for attachment and on which the lamp is configured to be supplied with power, the rails being electrically connected to the transformer, at least one first lamp being arranged on the rails and being configured to be supplied with power in a low-voltage range via the transformer and the rails; and at least one second lamp being arranged on a housing of the transformer, wherein the at least one second lamp is connected to receive a system voltage that is higher than the low-voltage range supplied to the first lamp.

2. The lighting device as claimed in claim 1, wherein the first lamp and the second lamp are of different lamp types.

3. The lighting device as claimed in claim 1, wherein the second lamp comprises a discharge lamp.

4. The lighting device as claimed in claim 1, wherein the housing of the transformer comprises a lamp holder, configured to receive a base of a second lamp.

5. The lighting device as claimed in claim 1, wherein the transformer comprises a toroidal-core transformer.

6. The lighting device as claimed in claim 1, wherein the transformer is electrically connected to a dimmer unit.

7. The lighting device as claimed in claim 1, wherein the second lamp is arranged between the two rails.

8. The lighting device as claimed in claim 1, wherein the rail device comprises two rails, which extend substantially parallel to one another and are arranged so as to be spaced apart from one another.

9. The lighting device as claimed in claim 1, further comprising: a transparent cover which covers the second lamp on a visible side, wherein the transparent cover is arranged to be attached to the housing of the transformer.

10. The lighting device as claimed in claim 1, further comprising: a reflector configured to be attached to the housing of the transformer.

11. The lighting device as claimed in claim 3, wherein the second lamp comprises a dimmable compact fluorescent lamp.

12. The lighting device as claimed in claim 6, wherein the transformer is electrically connected to a phase-gating dimmer.

* * * * *